US007036249B2

(12) United States Patent
Mautino

(10) Patent No.: US 7,036,249 B2
(45) Date of Patent: May 2, 2006

(54) TOOTH ADAPTER HAVING AN ELASTOMERIC CLAMP ASSEMBLY AND METHOD FOR USING SAME

(75) Inventor: Peter Scott Mautino, Pittsburgh, PA (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/444,771

(22) Filed: May 22, 2003

(65) Prior Publication Data

US 2004/0244236 A1 Dec. 9, 2004

(51) Int. Cl.
*E02F 9/28* (2006.01)

(52) U.S. Cl. ..... 37/457; 37/458; 37/455

(58) Field of Classification Search ..... 37/452, 37/455, 457, 458, 453–454, 456, 460
See application file for complete search history.

(56) References Cited

U.S. PATENT DOCUMENTS

| | | | | |
|---|---|---|---|---|
| 1,216,290 A | | 2/1917 | Dickson | |
| 1,419,047 A | | 6/1922 | Hanks et al. | |
| 1,845,677 A | | 2/1932 | Mekeel | |
| 1,917,431 A | * | 7/1933 | O'Fallon | 37/455 |
| 2,064,059 A | | 12/1936 | Fellmeth | 37/142 |
| 2,113,420 A | | 4/1938 | Younie | 37/141 |
| 2,618,873 A | | 11/1952 | Hostetter | 37/142 |
| 2,635,366 A | | 4/1953 | Hostetter | 37/142 |
| 2,689,419 A | | 9/1954 | Daniels et al. | 37/142 |
| 2,934,842 A | | 5/1960 | Buskirk | 37/142 |
| 3,027,201 A | | 3/1962 | Blazek et al. | 305/58 |
| 3,068,737 A | | 12/1962 | Mewse | 85/5 |
| 3,498,677 A | | 3/1970 | Morrow | 299/86 |
| 3,520,224 A | * | 7/1970 | Lucas et al. | 411/512 |

(Continued)

FOREIGN PATENT DOCUMENTS

AU 716828 6/1997

(Continued)

OTHER PUBLICATIONS

International Search Report for Trinity Industries, Inc., regarding International application No. PCT/US 03/20075, filed Jun. 25, 2003 signed by Donna-Marie Burns (8 pages) citing the above referenced patent documents.

(Continued)

*Primary Examiner*—Thomas A Beach
(74) *Attorney, Agent, or Firm*—Baker Botts L.L.P.

(57) ABSTRACT

A tooth adapter having an elastomeric clamp assembly and a method for using the same are provided. The system includes a tooth adapter having a first end operable to receive a removable tooth point and a second end having an upper blade and a lower blade, the upper and lower blades at least partially defining a cavity configured to receive a tooth horn. An upper insert is configured to be disposed at least partially within an orifice in the upper blade, and a lower insert is configured to be disposed at least partially within an orifice in the lower blade. A wedge member having an elastomeric portion disposed between its first and second faces is positioned at least partially within the cavity, through a slot in the tooth horn, such that when a fastener is used to couple the upper and lower inserts through the slot in the tooth horn, the first face of the wedge member engages the tooth horn and the second face of the wedge member engages the upper and lower inserts, forming a rigid coupling between the tooth adapter and the tooth horn.

16 Claims, 5 Drawing Sheets

U.S. PATENT DOCUMENTS

| | | | | | |
|---|---|---|---|---|---|
| 3,787,132 | A | | 1/1974 | Garnett | 403/290 |
| 3,831,298 | A | | 8/1974 | Helton et al. | 37/142 R |
| 3,839,805 | A | | 10/1974 | Stepe | 37/142 |
| 3,851,982 | A | * | 12/1974 | See | 403/224 |
| 3,879,867 | A | * | 4/1975 | Ericson et al. | 37/457 |
| 3,896,569 | A | | 7/1975 | Thompson et al. | 37/141 |
| 3,967,399 | A | | 7/1976 | Heinold et al. | 37/142 |
| 3,974,579 | A | | 8/1976 | Black et al. | 37/141 T |
| 3,982,339 | A | | 9/1976 | Nilsson | 37/141 |
| 4,067,657 | A | | 1/1978 | Kaarlela | 403/317 |
| 4,120,105 | A | * | 10/1978 | Stepe | 37/455 |
| 4,233,761 | A | | 11/1980 | Ryerson | 37/142 |
| 4,247,147 | A | | 1/1981 | Rettkowski | 299/10 |
| 4,271,615 | A | | 6/1981 | Jones | 37/142 A |
| 4,282,665 | A | * | 8/1981 | Fletcher et al. | 37/457 |
| 4,326,348 | A | | 4/1982 | Emrich | 37/142 |
| 4,335,532 | A | | 6/1982 | Hahn et al. | 37/142 |
| 4,404,760 | A | | 9/1983 | Hahn et al. | 37/142 |
| 4,414,764 | A | * | 11/1983 | Johansson et al. | 37/450 |
| 4,433,496 | A | | 2/1984 | Jones et al. | 37/141 R |
| 4,446,638 | A | * | 5/1984 | Novotny et al. | 37/457 |
| 4,481,728 | A | | 11/1984 | Mulder et al. | 37/142 |
| 4,587,751 | A | | 5/1986 | Sjogren et al. | 37/142 |
| 4,662,762 | A | | 5/1987 | Schwarz | 384/25 |
| 4,663,867 | A | | 5/1987 | Hahn et al. | 37/142 |
| 4,716,667 | A | | 1/1988 | Martin | 37/142 |
| 4,727,663 | A | | 3/1988 | Hahn | 37/142 |
| 4,782,607 | A | * | 11/1988 | Frisbee et al. | 37/455 |
| 4,823,487 | A | * | 4/1989 | Robinson | 37/457 |
| RE33,042 | E | | 9/1989 | Emrich | 37/142 R |
| 4,895,459 | A | | 1/1990 | Werner | 384/43 |
| 4,932,145 | A | * | 6/1990 | Reeves, Jr. | 37/451 |
| 4,941,758 | A | | 7/1990 | Osawa | 384/40 |
| 5,009,017 | A | | 4/1991 | Diekevers et al. | 37/142 |
| 5,074,062 | A | | 12/1991 | Hahn et al. | 37/142 |
| 5,081,774 | A | | 1/1992 | Kuwano | 137/142 |
| 5,088,214 | A | | 2/1992 | Jones | 37/141 |
| 5,111,600 | A | | 5/1992 | Lukavich et al. | 37/141 |
| 5,152,088 | A | | 10/1992 | Hahn | 37/142 |
| 5,172,501 | A | | 12/1992 | Pippins | 37/142 |
| 5,181,780 | A | | 1/1993 | Morita | 384/8 |
| 5,233,770 | A | | 8/1993 | Robinson | 37/456 |
| 5,263,351 | A | * | 11/1993 | Berg, III | 72/208 |
| 5,297,873 | A | | 3/1994 | Komiya | 384/45 |
| 5,337,495 | A | | 8/1994 | Pippins | 37/453 |
| 5,361,520 | A | | 11/1994 | Robinson | 37/458 |
| 5,410,826 | A | | 5/1995 | Immel et al. | 37/457 |
| 5,423,138 | A | | 6/1995 | Livesay et al. | 37/456 |
| 5,435,084 | A | | 7/1995 | Immel | 37/395 |
| 5,452,529 | A | * | 9/1995 | Neuenfeldt et al. | 37/455 |
| 5,469,648 | A | | 11/1995 | Jones et al. | 37/457 |
| 5,484,210 | A | | 1/1996 | Gallone | 384/49 |
| 5,491,915 | A | | 2/1996 | Robinson | 37/458 |
| 5,638,621 | A | | 6/1997 | Keech et al. | 37/446 |
| 5,709,043 | A | | 1/1998 | Jones et al. | 37/458 |
| 5,784,813 | A | * | 7/1998 | Balassa et al. | 37/455 |
| 5,802,795 | A | | 9/1998 | Myers et al. | 52/426 |
| 5,868,518 | A | * | 2/1999 | Chesterfield et al. | 403/379.4 |
| 5,909,962 | A | | 6/1999 | Livesay | 37/456 |
| 5,926,982 | A | | 7/1999 | Keech et al. | 37/455 |
| 5,937,549 | A | * | 8/1999 | Bender et al. | 37/455 |
| 5,937,550 | A | | 8/1999 | Emrich | 37/458 |
| 5,947,209 | A | | 9/1999 | Halford et al. | 172/772 |
| 5,983,534 | A | | 11/1999 | Robinson et al. | 37/459 |
| 5,992,063 | A | | 11/1999 | Mack | 37/450 |
| 6,000,153 | A | | 12/1999 | Sollami | 37/453 |
| 6,013,078 | A | | 1/2000 | Lin | 606/72 |
| 6,018,896 | A | | 2/2000 | Adamic | 37/456 |
| 6,052,927 | A | | 4/2000 | Pippins | 37/454 |
| 6,092,958 | A | | 7/2000 | Gale | 403/378 |
| 6,108,950 | A | | 8/2000 | Ruvang et al. | 37/452 |
| 6,119,378 | A | | 9/2000 | Pippins | 37/454 |
| 6,151,812 | A | | 11/2000 | Bierwith | 37/455 |
| 6,209,238 | B1 | * | 4/2001 | Ruvang | 37/455 |
| 6,247,255 | B1 | | 6/2001 | Clendenning | 37/452 |
| 6,301,810 | B1 | * | 10/2001 | Fidler | 37/458 |
| 6,374,521 | B1 | | 4/2002 | Pippins | 37/456 |
| 6,439,796 | B1 | * | 8/2002 | Ruvang et al. | 403/157 |
| 6,467,203 | B1 | | 10/2002 | Pippins | 37/452 |
| 6,467,204 | B1 | | 10/2002 | Creighton et al. | 37/456 |
| 6,502,336 | B1 | | 1/2003 | Pippins | 37/458 |
| 6,574,892 | B1 | | 6/2003 | Creighton | 37/456 |
| 2002/0000053 | A1 | | 1/2002 | Adamic et al. | 37/456 |
| 2002/0010994 | A1 | | 1/2002 | Hess | 29/426.5 |
| 2002/0023375 | A1 | | 2/2002 | Pippins | 37/457 |

FOREIGN PATENT DOCUMENTS

| | | | |
|---|---|---|---|
| AU | 199911346 | A1 | 1/1999 |
| AU | 200154094 | A1 | 6/2001 |
| CA | 2161505 | | 10/1995 |
| EP | 0 717 204 | A1 | 12/1995 |
| EP | 1156164 | | 11/2001 |
| GB | 303708 | | 1/1929 |
| GB | 364531 | | 4/1931 |
| GB | 836167 | | 6/1960 |
| WO | WO 95/01481 | | 1/1995 |

OTHER PUBLICATIONS

International Search Report for Trinity Industries, Inc., regarding International application No. PCT/US 02/27402 signed by Paul Faux (8 pages).

"Dragline Products—Hensley Style" (eleven pages), Nov. 12, 2002.

"Keech Castings Australia PTY. Limited," Aug. 31, 1995 (one page).

International Search Report for International application No. PCT/US 03/01664, filed Jan. 21, 2003 (5 pages), Mar. 15, 2004.

Notification of Transmittal of the International Search Report and the Written Opinion for International Application No. PCT/US2004/014631, filed May 10, 2004 (15 pages), Oct. 18, 2004.

* cited by examiner

TOOTH ADAPTER HAVING AN ELASTOMERIC CLAMP ASSEMBLY AND METHOD FOR USING SAME

TECHNICAL FIELD OF THE INVENTION

The present invention relates in general to replaceable excavation equipment components and, in particular, to a tooth adapter having an elastomeric clamp assembly and a method for using the same.

BACKGROUND OF THE INVENTION

Digging and leveling apparatus such as draglines, backhoes, front-end loaders and the like often use replaceable tooth assemblies which are mounted on tooth horns to provide sacrificial parts that are exposed to the repeated shock loading and high wear occasioned by the digging operation. In such systems, each tooth assembly typically includes a wedge-shaped adapter that mounts directly on the tooth horn of the bucket, shovel, or alternative digging or scraping mechanism of the equipment. This adapter is typically secured to the tooth horn using a wedge- or clamp-type assembly that extends through a set of orifices in the tooth adapter and a slot in the tooth horn to form a rigid coupling between the horn and adapter. With the adapter in place on the tooth horn, a wedge-shaped tooth point is frontally seated on and rigidly pinned to the adapter for engaging the material to be excavated.

SUMMARY OF THE INVENTION

In accordance with the present invention, a tooth adapter having an elastomeric clamp assembly and a method for using the same are provided. The system comprises a tooth adapter having a first end operable to receive a removable tooth point and a second end having an upper blade and a lower blade, the upper and lower blades at least partially defining a cavity configured to receive a tooth horn. An upper insert is configured to be disposed at least partially within an orifice in the upper blade, and a lower insert is configured to be disposed at least partially within an orifice in the lower blade. A wedge member having an elastomeric portion disposed between its first and second faces is positioned at least partially within the cavity, through a slot in the tooth horn, such that when a fastener is used to couple the upper and lower inserts through the slot in the tooth horn, the first face of the wedge member engages the tooth horn and the second face of the wedge member engages the upper and lower inserts, forming a rigid coupling between the tooth adapter and the tooth horn.

Technical advantages of particular embodiments of the present invention include a system and method for coupling a tooth adapter with a tooth horn that is less susceptible to loosening under repeated shock loading and high wear. Instead, the elastomeric clamp assembly provides a source of constant tension, reducing the possibility of loosening of the coupling that could lead to additional wear and/or failure of the adapter.

Another technical advantage of particular embodiments of the present invention is a system and method of coupling a tooth adapter and a tooth horn that is less sensitive to the alignment of the tooth horn and the clamp assembly. Instead, misalignment of the components is compensated for by the elasticity of the clamp assembly, which ensures a tight fit between the tooth horn and the clamp assembly.

Yet another technical advantage of particular embodiments of the present invention is a system and method for coupling a tooth adapter with a tooth horn such that the tooth adapter and tooth horn may be easily coupled and decoupled in the field by an operator using simple hand and/or power tools.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following descriptions, taken in conjunction with the accompanying drawings, in which.

DETAILED DESCRIPTION OF THE INVENTION

Figure 1:
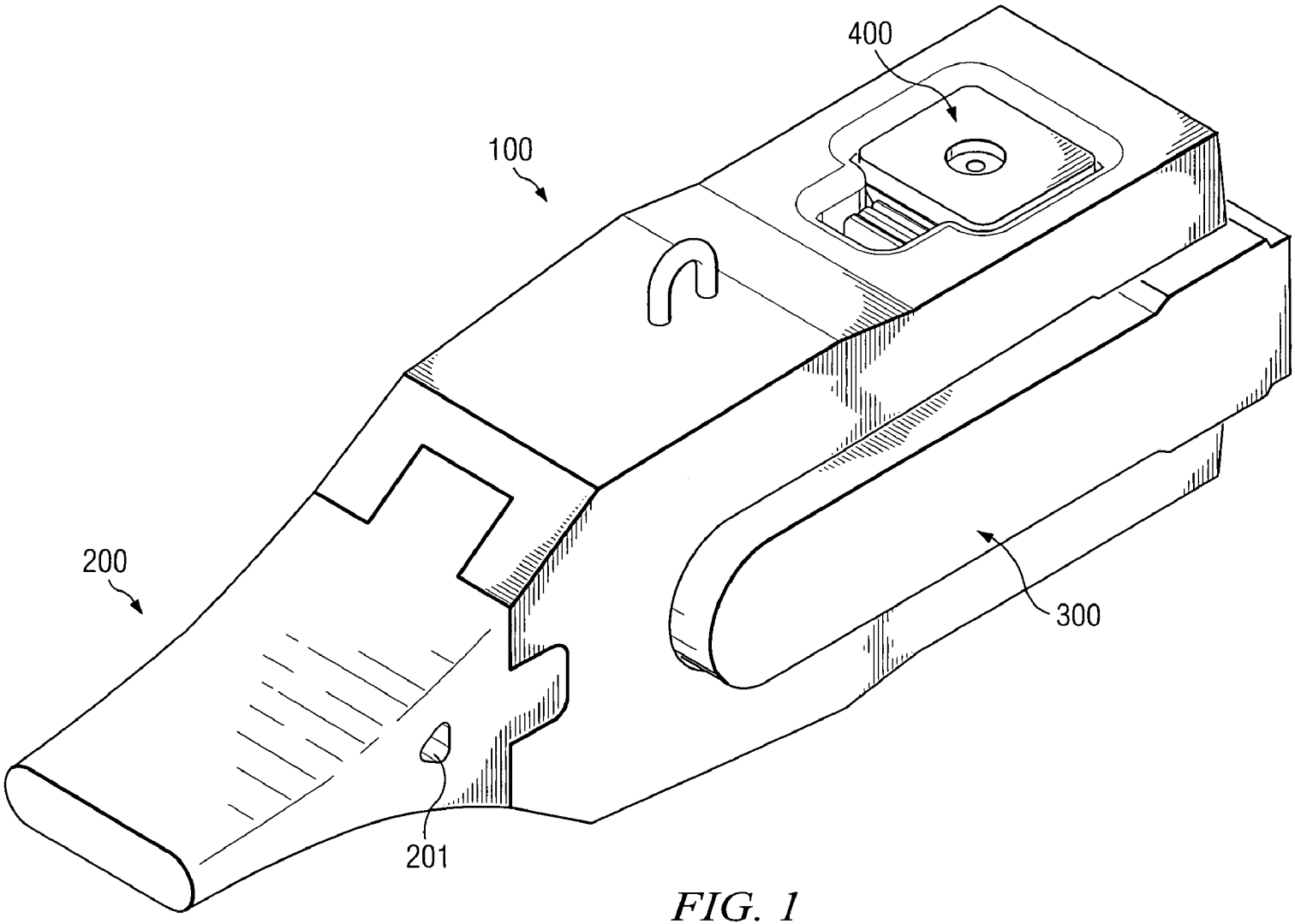
FIG. 1 illustrates an isometric view of a tooth adapter, coupled to a tooth horn and tooth point, in accordance with a particular embodiment of the present invention.

In accordance with a particular embodiment of the present invention, FIG. 1 illustrates a tooth adapter 100. Tooth adapter 100 is a wedge-shaped adapter which mounts directly on a tooth horn, such as tooth horn 300, which may be found on the bucket, shovel, or alternative digging or scraping mechanism of a variety of excavation equipment. Tooth adapter 100, which is coupled to the tooth horn using an elastomeric clamp assembly 400, protects the tooth horn from excessive wear and provides an attachment point for a wedge-shaped tooth point 200 that is frontally seated on and rigidly pinned to the adapter 100 for engaging material during excavation operations.

As tooth point 200 is subject to significant wear and tear during excavation and/or mining operations due to the extreme shock loading experienced as tooth point 200 impacts adjacent earth, rocks, and/or other abrasive material, it is often desirable to make tooth point 200 readily replaceable with a new or reconditioned tooth of a similar or identical configuration. Otherwise, buckets, shovels or other excavation equipment would need to be replaced more frequently, increasing equipment and labor costs associated therewith. By providing a replaceable tooth adapter 100 at a location upon the excavation equipment that experiences the most wear (i.e., tooth horn 300), the service life of the equipment may be prolonged by replacing selected parts associated with the excavation equipment.

In order to prevent this excessive wear to tooth horn 300, tooth adapter 100 is coupled with, and at least partially conceals and/or protects, tooth horn 300 from abrasive materials which are engaged during excavation. This coupling is accomplished, at least partially, by elastomeric clamp assembly 400. Elastomeric clamp assembly 400 is disposed at least partially through a pair of orifices in tooth adapter 100, an upper orifice in its upper blade and a lower orifice in its lower blade, and through a slot (not illustrated) in tooth horn 300 which connects the two orifices. As will be discussed in further detail below, once installed through the slot in the tooth horn, elastomeric clamp assembly 400 provides a strong, rigid coupling between tooth horn 300 and tooth adapter 100. For the purposes of this specification, the term "tooth horn" shall refer to any tooth horn, excavating lip, or the like which are used to mount adapters and/or teeth upon.

Figure 2:
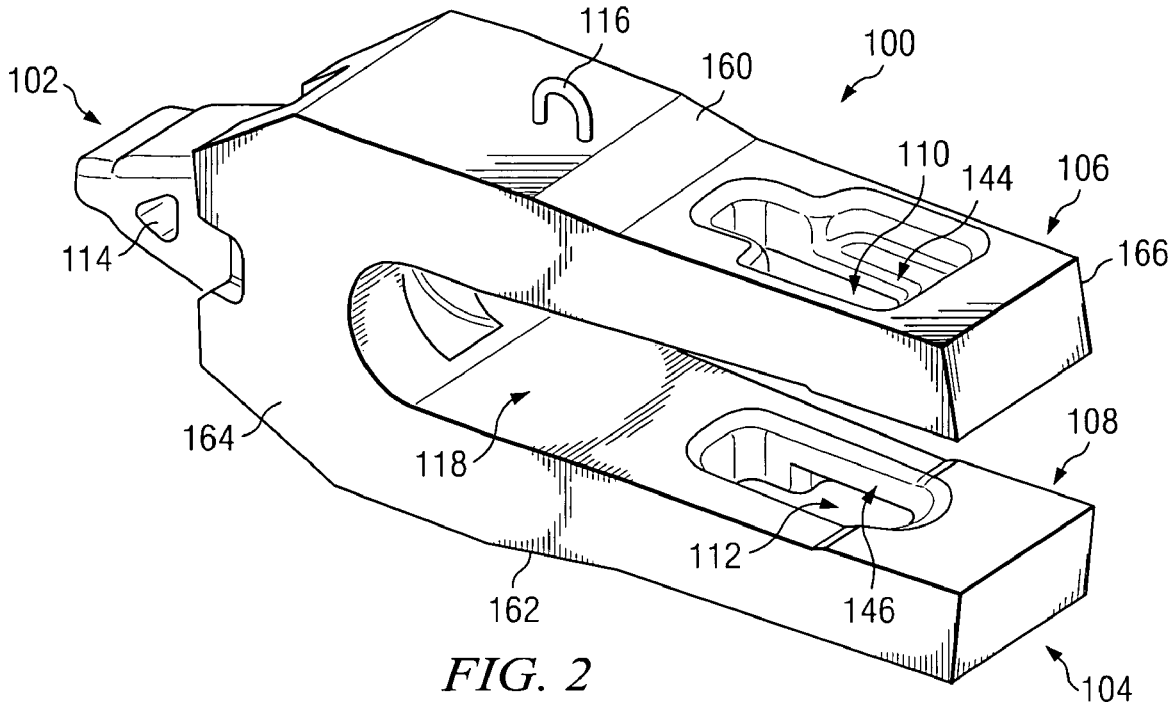
FIG. 2 illustrates an isometric view of a tooth adapter in accordance with a particular embodiment of the present invention.

A better understanding of tooth adapter 100 is provided by making reference to FIG. 2. As shown in FIG. 2, tooth adapter 100 includes first end 102 and second end 104. First end 102 of the adapter is configured to receive removable tooth point 200 (FIG. 1), which is designed to be readily replaceable with a new or reconditioned tooth of a similar or identical configuration. First end 102 also features retainer slot 114, which is configured to receive retainer pin 201 (FIG. 1) and facilitate the coupling of tooth point 200 with tooth adapter 100.

Second end 104, on the other hand, is configured to receive tooth horn 300. Second end 104 includes upper and lower blades 106 and 108, respectively. Upper and lower blades 106 and 108 at least partially define cavity 118, which is configured to receive tooth horn 300 such that when coupled with tooth horn 300, upper blade 106 engages the upper side of the tooth horn, while lower blade 108 engages the lower side to the tooth horn.

As is evident from FIG. 2, between the portion of first end 102 configured to receive tooth point 200 and second end 104, tooth adapter 100 generally tapers from wide to narrow along the upper and lower surfaces 160 and 162, respectively, and the left and right surfaces 164 and 166, respectively, of the adapter 100. This is due to the fact that most of the load placed on the adapter 100 is experienced by first end 102. Therefore, first end 102 is designed to withstand a greater load than second end 104, and, therefore, has a larger profile. However, it should be recognized by one of ordinary skill in the art that the tapered configuration of tooth adapter 100 may vary significantly within the teachings of the present invention. Furthermore, it should be recognized that this tapered configuration is not necessary to the teachings of the present invention. Nonetheless, such a tapered configuration may allow for the more economical use of materials, reducing the overall cost of manufacture of the adapter.

Tooth adapter 100 also includes lug 116 on the upper surface 160 of the adapter. Lug 116 is configured to assist in the assembly of tooth adapter 100 upon tooth horn 300 and allows a connection point for overhead lifts and other devices or tools which may facilitate mounting adapter 100 on tooth horn 300.

Once mounted on tooth horn 300, tooth adapter 100 is then rigidly coupled with the tooth horn. To facilitate this coupling, tooth adapter 100 includes an upper orifice 110 disposed in upper blade 106 and a lower orifice 112 disposed in lower blade 108. Orifices 110 and 112 are oriented to at least partially align with each other and with a slot through tooth horn 300 (not illustrated). In this manner, a wedge- or clamp-type member, such as elastomeric clamp assembly 400 (FIGS. 1 and 3–6) may be inserted through orifices 100 and 112 and through the slot (not illustrated) in tooth horn 300 (FIG. 1) to engage both tooth adapter 100 and tooth horn 300 and provide a rigid coupling between the two.

Figure 3:
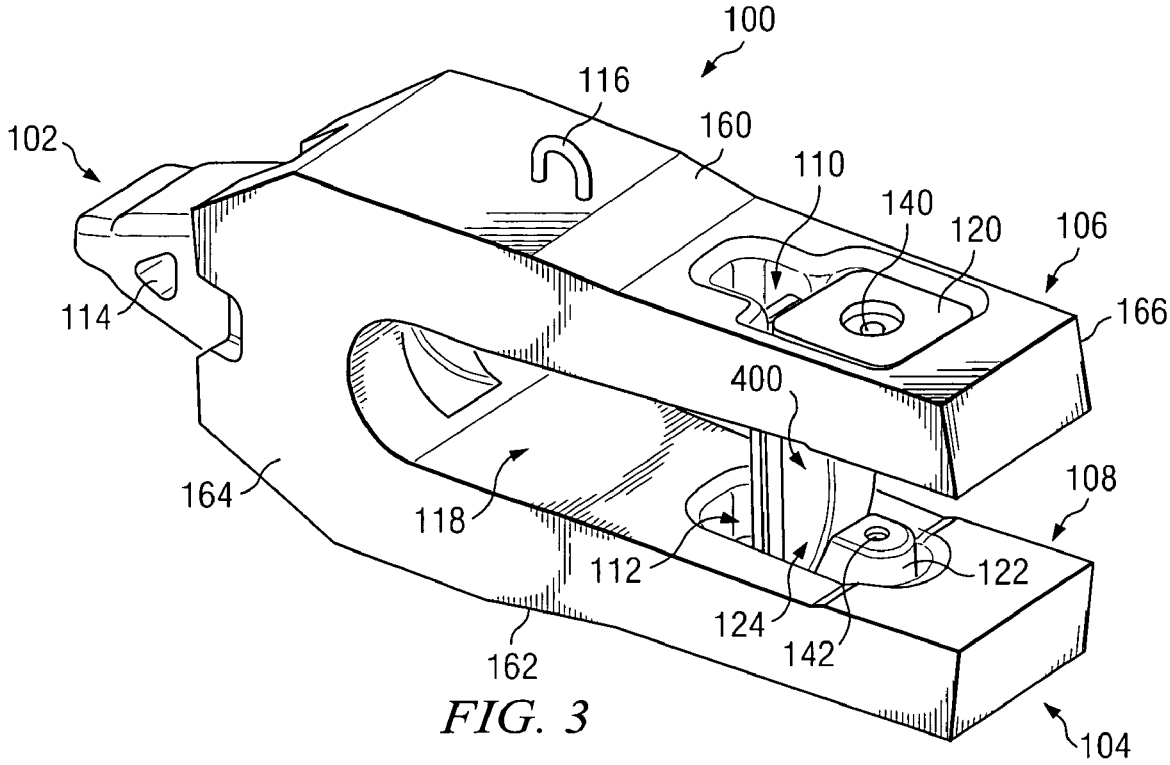
FIG. 3 illustrates an isometric view of the tooth adapter shown in FIG. 2, having an elastomeric clamp assembly in accordance with a particular embodiment of the present invention.

The interaction of tooth adapter 100 and elastomeric clamp assembly 400 is further shown in FIG. 3. As shown in FIG. 3, elastomeric clamp assembly 400 may be positioned through upper and lower orifices 110 and 112 and the slot in tooth horn 300 to provide a strong, rigid coupling between tooth adapter 100 and tooth horn 300.

Elastomeric clamp assembly 400 includes upper and lower inserts 120 and 122, respectively. Upper and lower inserts 120 and 122 are configured to be disposed at least partially within upper and lower orifices 110 and 112, respectively. Once installed in the orifices of the upper and lower blades, upper and lower inserts 120 and 122 are configured to be coupled together using a fastener (not illustrated) that extends through cavity 118, through the slot (not illustrated) in tooth horn 300 (FIG. 1). This coupling is facilitated by central orifices 140 and 142 in the upper and lower inserts 120 and 122, respectively, which are configured to receive the fastener. To assist in this coupling, either orifice 140 or 142, or both, may be configured to be threadably coupled with the fastener. Once upper and lower inserts 120 and 122 are coupled with the fastener, tightening the fastener draws the inserts 120 and 122 closer together, bring them in contact with wedge member 124, which is, in turn, configured to engage tooth horn 300 from within the slot (not illustrated) through the tooth horn. This assembly is further illustrated in FIG. 4.

Figure 4:
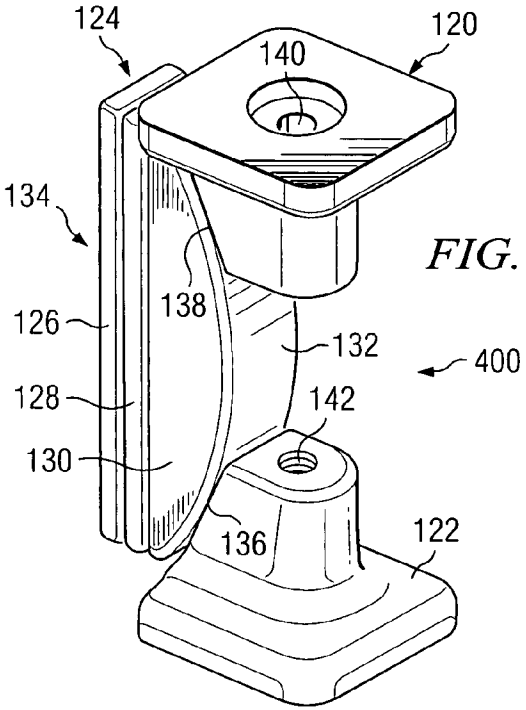
FIG. 4 illustrates an isometric view of the elastomeric clamp assembly shown in FIG. 3.

As shown in FIG. 4, wedge member 124 of elastomeric clamp assembly 400 actually comprises three distinct regions: first metallic member 126, elastomeric portion 128, and second metallic member 130.

Elastomeric portion 128, which may be constructed of a number of commercially available elastomers or practically any other compressible material that has a shape memory such that it will attempt to return to its original shape after deformation, is disposed between, and bonded to, metallic members 126 and 130. Metallic members 126 and 130, in comparison, are configured to engage the tooth horn and upper and lower inserts, respectively, and are therefore constructed of high-grade carbon steel or some other suitable material.

Coupled to a first face of elastomeric portion 128, metallic member 126 comprises first surface 134 of wedge member 124, which is configured to flushly interface with tooth horn 300 (FIG. 1) from within the slot (not illustrated) in the horn 300. Therefore, in this embodiment, surface 134 is illustrated as having a generally flat profile. However, it should be understood by one of ordinary skill in the art that surface 134 could have other profiles adapted to engage a tooth horn, and still be within the teachings of the present invention.

In contrast to metallic member 126, metallic member 130, which is coupled to a second face of elastomeric portion 128, is illustrated as generally semi-cylindrical, featuring a half-moon profile. This half-moon profile allows second surface 132 of the wedge member 124 to engage upper and lower inserts 120 and 122 along surfaces 138 and 136, respectively. The corresponding shapes of surfaces 138 and 136 of inserts 120 and 122, respectively, cooperate with the half-moon profile of metallic member 130 to slide along surface 132 as inserts 120 and 122 are brought closer together by the tightening of the fastener (not illustrated) coupling the two. This, in turn, forces wedge member 124 towards first end 102 of the tooth adapter 100 and helps form a tighter coupling between the tooth horn 300 and tooth adapter 100 in response to pressure exerted on the wedge member 124 by upper and lower inserts 120 and 122.

Figure 5:
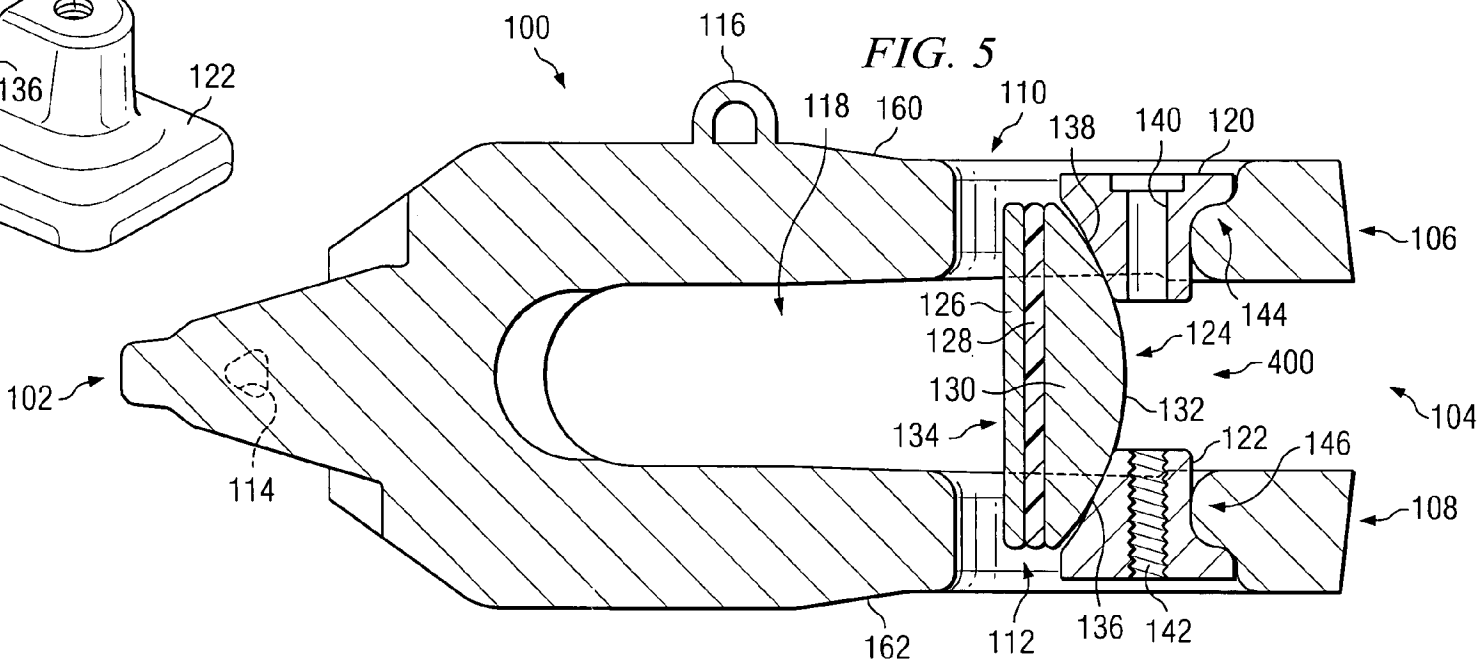
FIG. 5 illustrates a cut-away side view of the tooth adapter having an elastomeric clamp assembly shown in FIG. 3.
Figure 6:
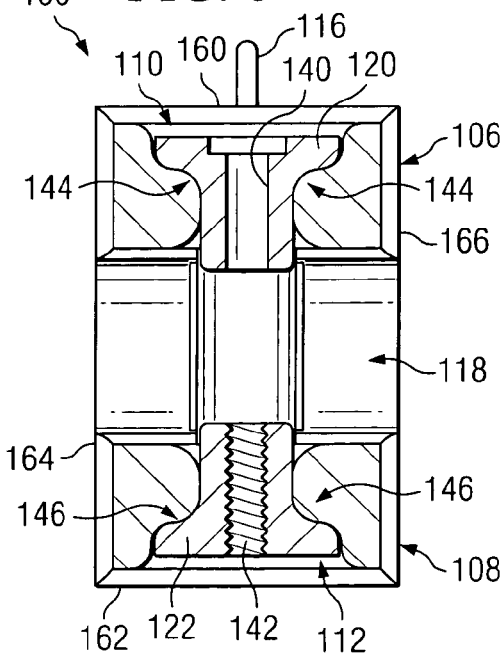
FIG. 6 illustrates a cut-away end view of the tooth adapter having an elastomeric clamp assembly shown in FIG. 3.

Much of this interaction between the components of elastomeric clamp assembly 400 is further discussed in relation to FIGS. 5 and 6, which illustrate cut-away views of tooth adapter 100 and elastomeric clamp assembly 400, such shown in FIG. 3, with FIG. 5 representing a side view and FIG. 6 representing an end view.

As shown in FIG. 5, when elastomeric clamp assembly 400 is positioned within the slot (not illustrated) in tooth horn 300 (FIG. 1), upper and lower inserts 120 and 122 are at least partially disposed in orifices 110 and 112, respectively, such that they engage surface 132 of wedge member 124.

However, while positioned in orifice 110, upper insert 120 is prevented from extending too far into cavity 118 by upper lip 144, which extends at least partially around upper orifice 110. Similarly, lower insert 122 is prevented from extending too far into cavity 118 by lower lip 146, which extends at least partially around lower orifice 112.

Also, as is evident in FIG. 5, first surface 134 of wedge member 124 need not engage any part of tooth adapter 100. Instead, surface 134 may engage tooth horn 300 (FIG. 1), alone, and be within the teaching of the present invention.

As mentioned above, upper and lower inserts 120 and 122 include central orifices 140 and 142, respectively, which are configured to engage a fastener (not illustrated) through the slot (not illustrated) in tooth horn 300 (FIG. 1). To assist in this coupling, either orifice 140 or 142, or both, may be configured to be threadably coupled with the fastener. Tightening the fastener draws upper and lower inserts 120 and 122 closer together, bringing surfaces 138 and 136 of inserts 120 and 122, respectively, in contact with surface 132 of wedge member 124. As mentioned above, the shape of these surfaces 138 and 136 cooperate with the half-moon profile of surface 132 of wedge member 124. Once upper and lower inserts 120 and 122 are in contact with surface 132, continuing to tighten the fastener will continue to bring inserts 120 and 122 closer together. As this happens, surfaces 138 and 136 slide along surface 132 of wedge member 124, forcing the first surface 134 of wedge member 124 towards tooth horn 300 (FIG. 1) and end 102 of tooth adapter 100. This results in a tighter coupling between the tooth adapter 100 and tooth horn 300 (FIG. 1).

In the event surface 134 is already in contact with the tooth horn, continued tightening of the fastener will result in the compression of elastomeric portion 128. This allows additional pressure to be applied the wedge member 124, and therefore the tooth horn 300 (FIG. 1), without damaging the clamp assembly. Any excess pressure applied will be stored in the compression of elastomeric portion 128.

The compression of elastomeric portion 128 also allows the clamp assembly 400 to compensate for any loosening of the fastener (not illustrated) coupling upper and lower inserts 120 and 122 that may occur during operation of the excavation equipment to which tooth adapter 100 is coupled. Any clearance or slack that would be created under other conditions is eliminated or at least alleviated by the decompression of elastomeric portion 128 to fill this clearance and maintain adequate pressure on the tooth horn. In addition to maintaining adequate pressure on the tooth horn, this "constant tension" also alleviates additional wear on the adapter 100 that could result from the loosening of the fastener, possibly leading to the failure/breakage of the adapter 100.

Elastomeric portion 128 also helps to compensate for slightly off-center installations of wedge member 124. In the event wedge member 124 is slightly misaligned with the tooth horn (i.e., first surface 134 is not entirely flush with the surface of tooth horn it engages), elastomeric portion 128 allows for a strong coupling between tooth adapter 100 and tooth horn 300 (FIG. 1) despite the misalignment. As upper and lower inserts 120 and 122 are brought closer together by the tightening of the fastener and the first surface 134 of wedge member 124 is forced towards end 102 and the tooth horn 300 (FIG. 1), elastomeric portion 128 may be compressed asymmetrically, such that the previous misalignment is compensated for by the asymmetric compression of elastomeric portion 128, bringing the first surface 134 of wedge member 124 flush with the surface of the tooth horn it is configured to engage.

Figure 7:
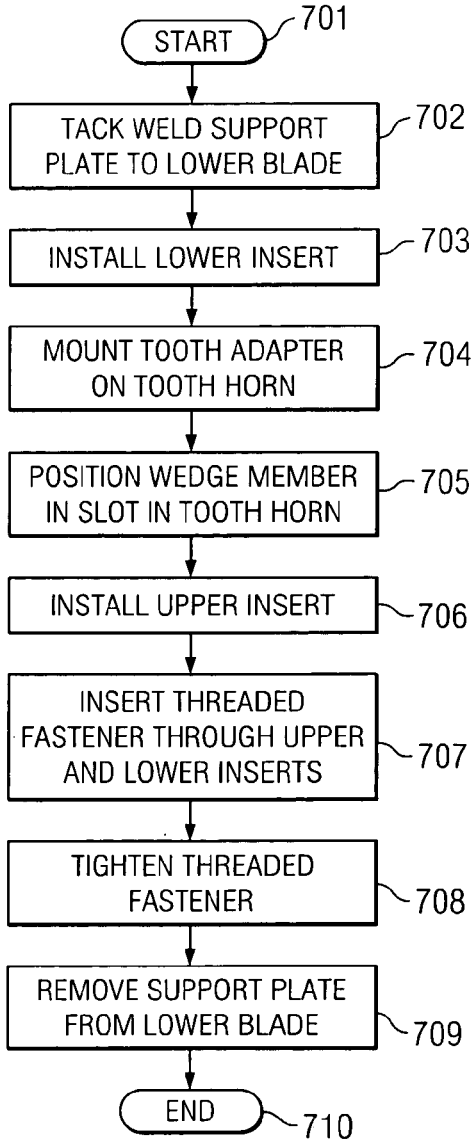
FIG. 7 illustrates a flowchart depicting a method of coupling a tooth adapter with a tooth horn using an elastomeric clamp assembly in accordance with a particular embodiment of the present invention.

The use of elastomeric clamp assembly 400 also allows tooth adapter 100 to be easily coupled and decoupled with tooth horn 300 (FIG. 1) in the field by an operator, using simple hand and/or power tools. FIG. 7 illustrates a flowchart of such a method of coupling a tooth adapter with a tooth horn using an elastomeric clamp assembly.

Figure 8:
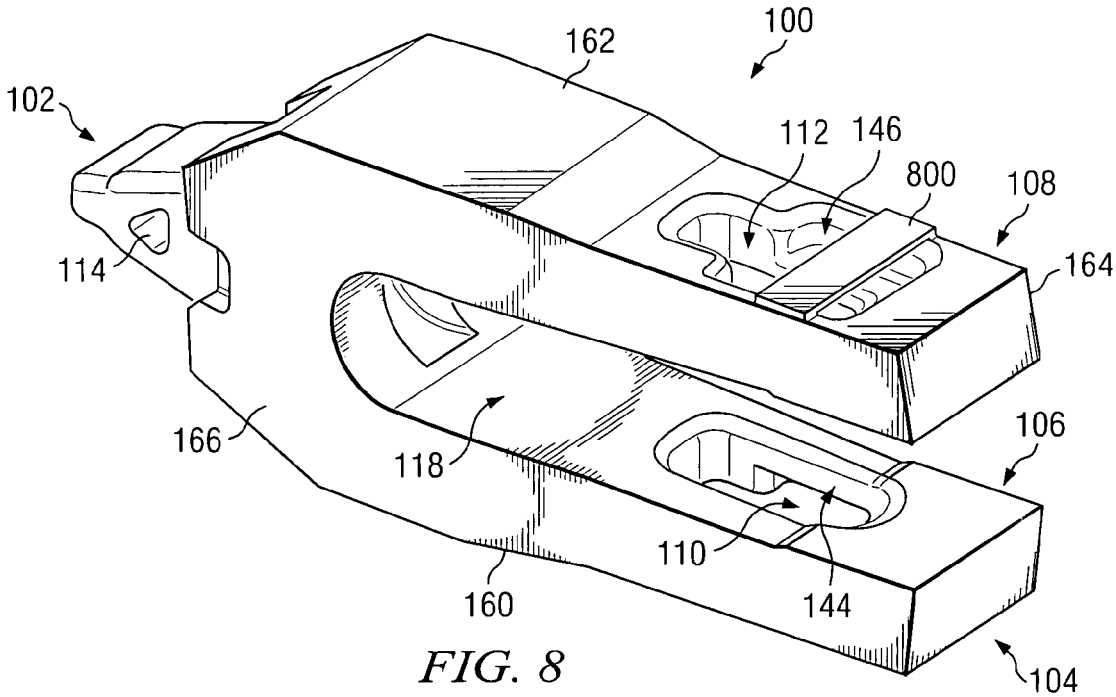
FIG. 8 illustrates an isometric view of the tooth adapter shown in FIG. 2, having a support plate removably coupled with the lower blade of the tooth adapter in accordance with a particular embodiment of the present invention.

Particular embodiments of the present invention may also include a support plate 800 to facilitate the coupling of tooth adapter with tooth horn 300 (FIG. 1). This is illustrated in FIG. 8. As shown in FIG. 8, support plate 800 is removably coupled to lower blade 108, such as by tack welding, and at least partially covers lower orifice 112. In this way, support plate 800 provides a support mechanism for lower insert 122 (FIG. 3). Rather than being held in place by an operator while disposed in lower orifice 122 awaiting to be coupled with upper insert 120 (FIG. 3), lower insert 122 may instead rest upon support plate 800. This frees the operator to perform other functions and eases the installation of tooth adapter 100 on tooth horn 300. Once tooth adapter 100 is coupled with tooth horn 300, support plate 800 may then be optionally decoupled from lower blade 108.

FIG. 7 illustrates a flowchart depicting a method of coupling a tooth adapter with a tooth horn using an elastomeric clamp assembly in accordance with a particular embodiment of the present invention.

As shown in FIG. 7, after starting in block 701, a support plate may be optionally tack welded, or otherwise removably coupled, to the lower blade of the tooth adapter such that the lower orifice in the lower blade is at least partially covered. This assists in the assembly of the tooth adapter upon the tooth horn by providing a support mechanism for the lower insert, freeing an operator from holding the lower insert in place during installation.

In block 703, the lower insert of the elastomeric clamp assembly is disposed at least partially in the lower orifice in the lower blade of the tooth adapter. As mentioned above in regard to block 702, if a support plate has been coupled with the tooth adapter in block 702, the support plate may be used to support the lower insert as discussed above.

Next, the tooth adapter is mounted on the tooth horn in block 704, such that the upper and lower orifices of the tooth adapter are aligned with the slot in the tooth horn.

In block 705, the wedge member is then positioned through the slot in the tooth horn, such that a first face of the wedge member engages the tooth horn and a second face of the wedge member engages the lower insert.

Then, in block 706, the upper insert of the elastomeric clamp assembly is disposed at least partially in the upper orifice in the upper blade of the tooth adapter, such that it engages second face of the wedge member, as well.

A fastener is then inserted through the central orifices of the upper and lower inserts in block 707 and tightened in block 708, forming a strong, rigid coupling between the tooth adapter and the tooth horn.

Lastly, the support plate that was optionally installed in block 702 may be removed in block 709 before the installation process terminates in block 710.

Coupling a tooth adapter with a tooth horn in such a manner using an elastomeric clamp assembly in accordance with a particular embodiment of the present invention provides a coupling that is less susceptible to loosening under repeated shock loading and high wear that could lead to additional wear and/or failure of the adapter. Instead, the elastomeric clamp assembly provides a source of constant tension, reducing the possibility of loosening of the coupling leading to equipment failure.

Similarly, particular embodiments of the present invention provide a coupling between a tooth adapter and a tooth horn that is less sensitive to the alignment of the tooth horn and the clamp assembly. Due to the elasticity of the clamp assembly, any misalignment of the components is compensated for as the elastomer ensures a tight fit between the tooth horn and the clamp assembly.

Particular embodiments of the present invention also provide the ability to couple a tooth adapter with a tooth horn such that the tooth adapter and tooth horn may be easily coupled and/or decoupled in the field by an operator, using simple hand and/or power tools.

Although particular embodiments of the method and apparatus of the present invention have been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims.

What is claimed is:

1. A system for coupling excavation components, comprising:

a tooth adapter having a first end operable to receive a removable tooth point and a second end having an upper blade and a lower blade, the upper and lower blades at least partially defining a cavity configured to receive a tooth horn;

an upper insert configured to be disposed at least partially within an orifice in the upper blade;

a lower insert configured to be disposed at least partially within an orifice in the lower blade;

a wedge member configured to be positioned at least partially within the cavity, through a slot in the tooth horn, the wedge member having a first surface configured to engage the tooth horn and a second surface configured to engage the upper and lower inserts, and the wedge member including an elastomeric portion disposed between the first and second surfaces of the wedge member;

wherein the upper and lower inserts are each configured to engage a fastener through the slot in the tooth horn; and a support plate removably coupled with the lower blade of the tooth adapter, the support plate being positioned to at least partially cover the orifice in the lower blade and operable to support the lower insert.

2. The system of claim 1, wherein the wedge member further comprises first and second metallic members that form the first and second surfaces, respectively, and wherein the elastomeric portion includes first and second faces, the first face of the elastomeric portion being coupled to the first metallic member and the second face of the elastomeric portion being coupled to the second metallic member.

3. The system of claim 2, wherein the first and second metallic members are bonded to the first and second faces of the elastomeric portion, respectively.

4. The system of claim 2, wherein the second metallic member includes a generally semi-cylindrical member.

5. The system of claim 4, wherein the upper and lower inserts each include a curved surface corresponding to a profile of the generally semi-cylindrical member, the curved surfaces being configured to slide along the generally semi-cylindrical member as the fastener coupling the upper and lower inserts brings the upper and lower inserts closer together.

6. The system of claim 1, wherein the lower insert is configured to be threadably coupled with the fastener.

7. The system of claim 1, wherein the upper insert is configured to be threadably coupled with the fastener.

8. The system of claim 1, wherein the support plate is tack welded to the lower blade of the tooth adapter.

9. The system of claim 1, further comprising a lug disposed upon an upper surface of the tooth adapter, the lug being configured to assist in assembly of the tooth adapter upon the tooth horn.

10. A method of coupling a tooth adapter with a tooth horn, comprising:

mounting a tooth adapter on a tooth horn, the tooth adapter having a first end operable to receive a removable tooth point and a second end having an upper blade and a lower blade, the upper and lower blades at least partially defining a cavity configured to receive the tooth horn;

installing a lower insert in an orifice in the lower blade of the tooth adapter;

positioning a wedge member having first and second surfaces and an elastomeric portion disposed between the first and second surfaces, at least partially within the cavity, through a slot in the tooth horn;

installing an upper insert in an orifice in the upper blade of the tooth adapter;

inserting a fastener through the upper and lower inserts; and tightening the fastener such that the upper and lower inserts are brought in contact with the wedge member, such that the first surface of the wedge member engages the tooth horn and the second surface of the wedge member engages the upper and lower inserts;

removably coupling a support plate at least partially over the orifice in the lower blade; and wherein the support plate is configured to support the lower member.

11. The method of claim 10, wherein removably coupling the support plate comprises tack welding the support plate.

12. The method of claim 10, wherein the wedge member further comprises first and second metallic members that form the first and second surfaces, respectively, and wherein the elastomeric portion includes first and second faces, the first face of the elastomeric portion being coupled to the first metallic member and the second face of the elastomeric portion being coupled to the second metallic member.

13. The method of claim 12, wherein the first and second metallic members are bonded to the first and second faces of the elastomeric portion, respectively.

14. The method of claim 12, wherein the second metallic member includes a generally semi-cylindrical member.

15. The method of claim 10, wherein the lower insert is configured to be threadably coupled with the fastener.

16. The method of claim 10, wherein the upper insert is configured to be threadably coupled with the fastener.

* * * * *